US007461481B2

(12) United States Patent
Tsai

(10) Patent No.: US 7,461,481 B2
(45) Date of Patent: Dec. 9, 2008

(54) SHOCK-ABSORBING TIE BRACE

(76) Inventor: Chong-Shien Tsai, 6F-2, No. 5, Lane 466, Minchuan Rd., North Dist., Taichung (TW)

( * ) Notice: Subject to any disclaimer, the term of this patent is extended or adjusted under 35 U.S.C. 154(b) by 938 days.

(21) Appl. No.: 10/841,277

(22) Filed: May 7, 2004

(65) Prior Publication Data

US 2005/0257450 A1 Nov. 24, 2005

(51) Int. Cl.
*E04B 1/98* (2006.01)
*E04H 9/02* (2006.01)

(52) U.S. Cl. ..... 52/167.3; 52/836

(58) Field of Classification Search ..... 52/167.3, 52/167.4, 167.8, 730.1, 698, 836; 267/136, 267/141, 141.1; 188/378–380
See application file for complete search history.

(56) References Cited

U.S. PATENT DOCUMENTS 5,471,810 A * 12/1995 Sugisawa et al. ..... 52/731.7
6,826,874 B2 * 12/2004 Takeuchi et al. ..... 52/167.3
6,837,010 B2 * 1/2005 Powell et al. ..... 52/167.3
7,174,680 B2 * 2/2007 Smelser ..... 52/167.3
7,185,462 B1 * 3/2007 Smelser ..... 52/167.3
7,188,452 B2 * 3/2007 Sridhara ..... 52/167.3
7,225,588 B2 * 6/2007 Nakamura et al. ..... 52/167.3
7,284,358 B2 * 10/2007 Smelser ..... 52/745.17
7,305,799 B2 * 12/2007 Smelser et al. ..... 52/167.3
2001/0000840 A1 * 5/2001 Takeuchi et al. ..... 52/167.1
2002/0129568 A1 * 9/2002 Oka ..... 52/167.3
2003/0205008 A1 * 11/2003 Sridhara ..... 52/167.3
2004/0074161 A1 * 4/2004 Kasai et al. ..... 52/167.1
2004/0107654 A1 * 6/2004 Powell et al. ..... 52/167.3
2005/0166487 A1 * 8/2005 Tsai ..... 52/167.3
2005/0257490 A1 * 11/2005 Pryor et al. ..... 52/736.3

FOREIGN PATENT DOCUMENTS

JP 2002235380 A * 8/2002
JP 2003314080 A * 11/2003
JP 2004060234 A * 2/2004
JP 2004232292 A * 8/2004

* cited by examiner

*Primary Examiner*—Robert J Canfield
*Assistant Examiner*—Charissa Ahmad
(74) *Attorney, Agent, or Firm*—William E. Pelton, Esq.; Cooper & Dunham LLP

(57) ABSTRACT

A shock-absorbing tie brace has a central member and two primary containment members. The central member has a top, a bottom, a resilient body with two nonlinear edges and two lateral containment members separately mounted at the two nonlinear edges of the resilient body to define a gap between each lateral containment member and the corresponding edge of the resilient body. The primary containment members are mounted respectively on the top and bottom of the central member and are attached to the lateral containment members of the central member. Accordingly, the shock-absorbing tie brace is easily manufactured and has an enhanced structural strength.

15 Claims, 13 Drawing Sheets

SHOCK-ABSORBING TIE BRACE

BACKGROUND OF THE INVENTION

1. Field of the Invention

The present invention relates to a shock-absorbing tie brace, and more particularly to a shock-absorbing tie brace used in structures to absorb shock transmitted from columns to beams connected to the columns in the frames of structures.

2. Description of Related Art

To enhance the strength of a structure, tie braces are always mounted at an angle respectively between columns and beams supported by the columns in structures to stiffen the frame of the structure, and shock-absorbing tie braces also absorb shock applied to the structure. A conventional shock-absorbing tie brace in accordance with the prior art comprises a central member, multiple side members and multiple connecting plates. The central member has an X-shaped cross section and is composed of three steel plates welded together. The side members are mounted around the central member to define a passage between the side members through which the central member slidably extends. The connecting plates are securely attached to the side members to connect the side members together and to provide structural strength to prevent buckling.

However, assembling the conventional shock-absorbing tie brace is difficult, time consuming and expensive. The central member is easily bent or deformed during the welding process, such that a straightening process must be applied subsequently to the bent or deformed central member. The central member is easily damaged during the straightening process, and the structural strength is reduced.

To overcome the shortcomings, the present invention provides a shock-absorbing tie brace to mitigate or obviate the aforementioned problems.

SUMMARY OF THE INVENTION

The main objective of the invention is to provide a shock-absorbing tie brace that is easily manufactured and has enhanced structural strength. The shock-absorbing tie brace has at least two primary containment members and at least one central member. The primary containment members have two edges. Each central member has a top, a bottom, a resilient body and two lateral containment members. The resilient body has two nonlinear edges. The lateral containment members respectively have a straight edge and a nonlinear edge and are mounted between two primary containment members. The nonlinear edges of each resilient body correspond respectively to the nonlinear edges of the corresponding lateral containment members. The straight edges of the lateral containment members are flush respectively with the edges of the corresponding primary containment members. The resilient body of each central member is mounted between the lateral containment members such that a gap is defined between each lateral containment member and the corresponding nonlinear edge of the resilient body. Each resilient body is mounted slidably between the corresponding primary containment members.

Other objects, advantages and novel features of the invention will become more apparent from the following detailed description when taken in conjunction with the accompanying drawings.

DETAILED DESCRIPTION OF PREFERRED EMBODIMENT

Figure 1:
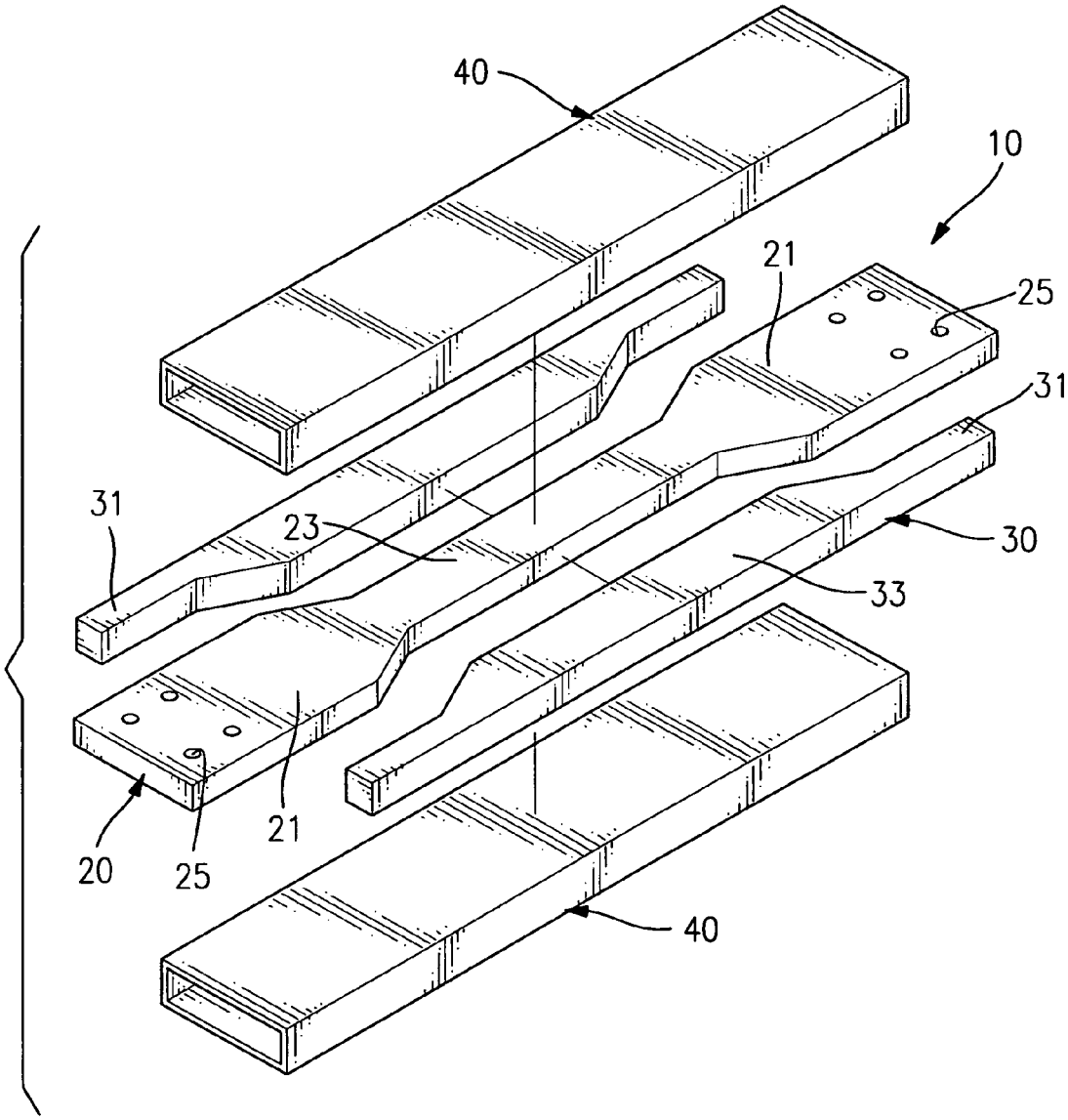
FIG. 1 is an exploded perspective view of a first embodiment of a shock-absorbing tie brace in accordance with the present invention.
Figure 2:
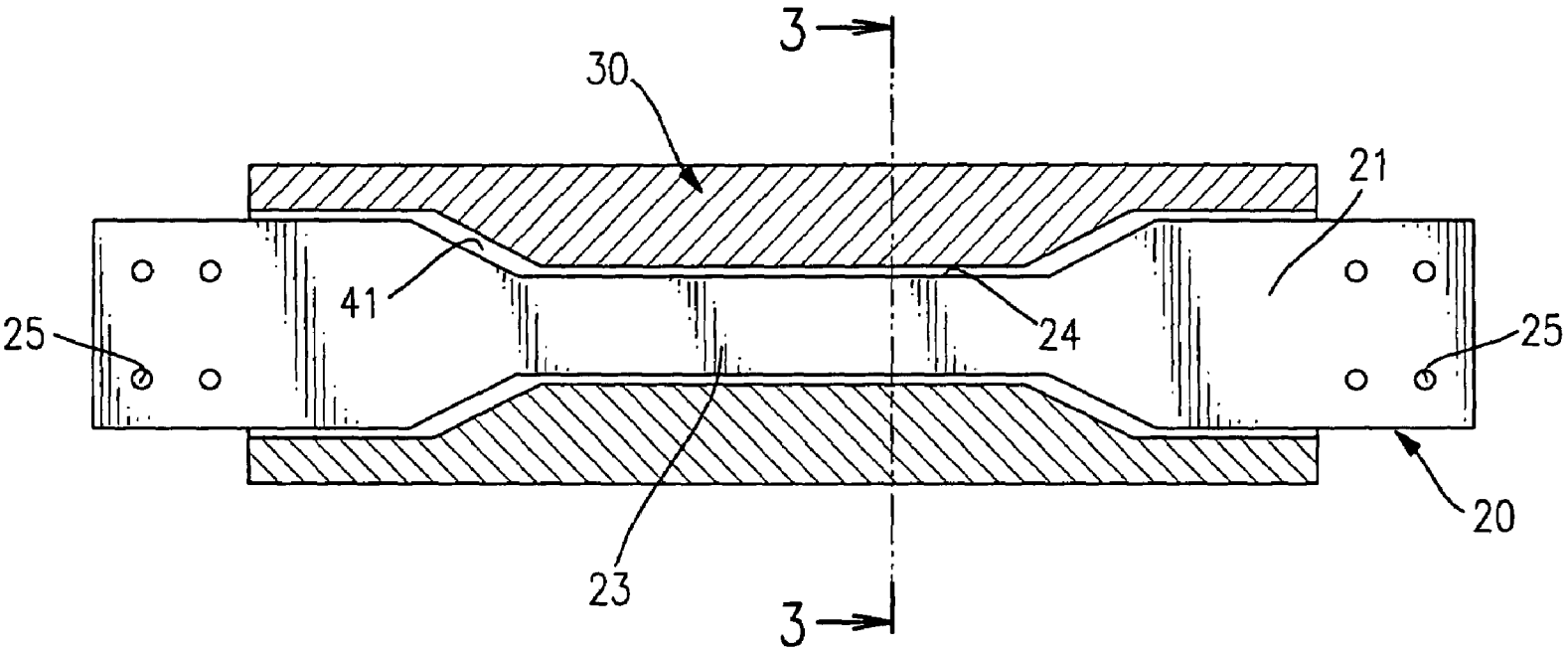
FIG. 2 is a top view in partial section of the shock-absorbing tie brace in FIG. 1.
Figure 3:
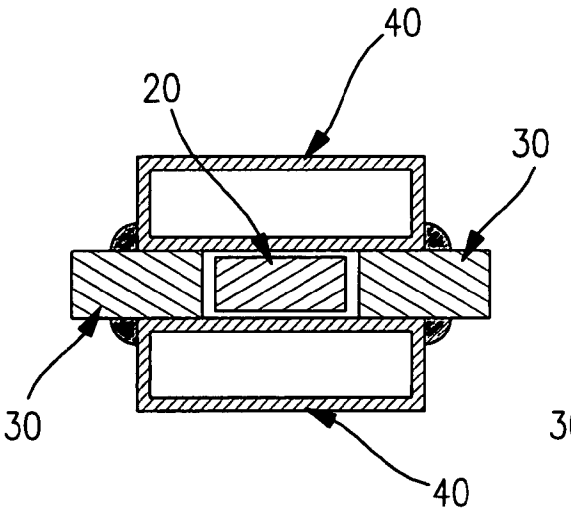
FIG. 3 is a cross sectional end view of the shock-absorbing tie brace along line 3-3 in FIG. 2.

A shock-absorbing tie brace in accordance with the present invention comprises at least two primary containment members and at least one central member. The primary containment members have two edges. Each central member has a top and a bottom and comprises a resilient body and two lateral containment members. The resilient body has two nonlinear edges. The lateral containment members respectively have a straight edge and a nonlinear edge and are mounted between two primary containment members. The nonlinear edges of each resilient body correspond respectively to the nonlinear edges of the corresponding lateral containment members. The straight edges of the lateral containment members are flush respectively with the edges of the corresponding primary containment members. The resilient body of each central member is mounted between the lateral containment members such that a gap is defined between each lateral containment member and corresponding nonlinear edge of the resilient body. The resilient body of each central member is mounted slidably between the corresponding primary containment members With reference to FIGS. 1 to 3, a first embodiment of the shock-absorbing tie brace comprises a central member (10) and two primary containment members (40). The central member (10) has a top (not numbered) and a bottom (not numbered) and comprises a resilient body (20) and two lateral containment members (30). The resilient body (20) has two nonlinear edges (not numbered), two enlarged ends (21), a neck (23), two recesses (24) and multiple optional through holes (25). The enlarged ends (21) have a width (not numbered). The neck (23) is formed between the enlarged ends (21) and has a width (not numbered). The width of the neck (23) is smaller than the width of the enlarged ends (21), and the smaller width of the neck (23) defines the two recesses (24) respectively in opposite edges of the resilient body (20). The optional through holes (25) are defined respectively in the enlarged ends (21).

The lateral containment members (30) are mounted respectively at the two sides of the resilient body (20) to define a gap (41) between each lateral containment member (30) and the corresponding edge of the resilient body (20). Each lateral containment member (30) has two narrow ends (31) and a wide middle (33) formed between the narrow ends (31). The wide middle (33) of the each lateral containment member (30) corresponds to the neck (23) of the resilient body (20) and is mounted in a corresponding recess (24). In an optional embodiment, the resilient body (20) has a thickness smaller than that of the lateral containment members (30).

The primary containment members (40) are mounted respectively on the top and bottom of the central member (10) and are securely attached to the lateral containment members (30) of the central member (10). In the first embodiment, the primary containment members (40) are tubular members and are rectangular in cross section. In an optional embodiment, the primary containment members (40) are welded to the lateral containment members (30). Consequently, a passage is defined between the lateral containment members (30) and the primary containment members (40), and the resilient body (20) can slide in the passage.

The shock-absorbing tie brace is assembled by putting the resilient body (20) and the lateral containment members (30) on one of the primary containment members (40) such that gaps (41) are formed between the resilient body (20) and the lateral containment members (30). The primary containment members (40) are then welded to the lateral containment members (30). In an alternative embodiment, the primary containment members (40) can be attached to the lateral containment members (30) with fasteners, such as bolts, screws or rivets.

Accordingly, the enlarged ends (21) of the resilient body (20) can be attached to a column and a beam of a structure with bolts extending through the through holes (25) in the enlarged ends (21) of the resilient body (20). The shock-absorbing tie braces enhance the structural strength of any structure in which they are installed. Earthquake shock will be absorbed by deformation of the resilient bodies (20) in the shock-absorbing tie braces in the structure. The primary containment members (40) keep the resilient body (20) from buckling during the deformation of the resilient body (20).

Figure 4:
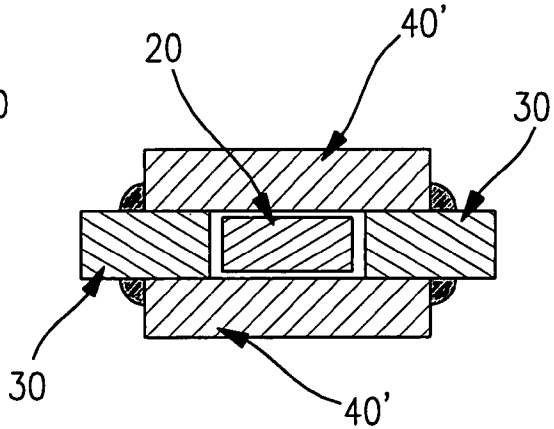
FIG. 4 is a cross sectional view of a second embodiment of a shock-absorbing tie brace in accordance with the present invention.

With reference to FIG. 4, a second embodiment of the shock-absorbing tie brace in accordance with the present invention is substantially the same as the first embodiment except that the primary containment members (40') are solid plates.

Figure 5:
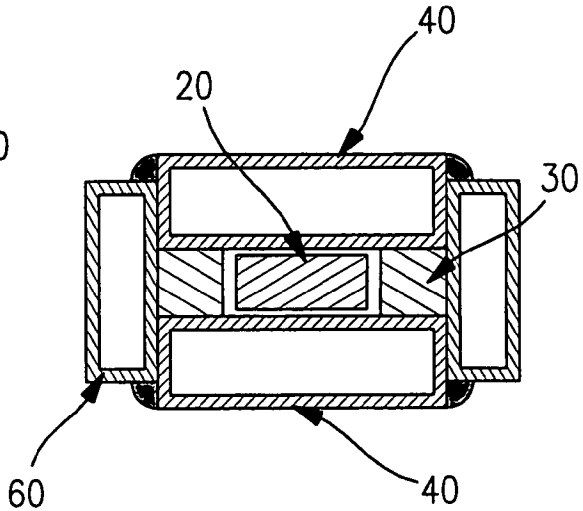
FIG. 5 is a cross sectional end view of a third embodiment of a shock-absorbing tie brace in accordance with the present invention.
Figure 6:
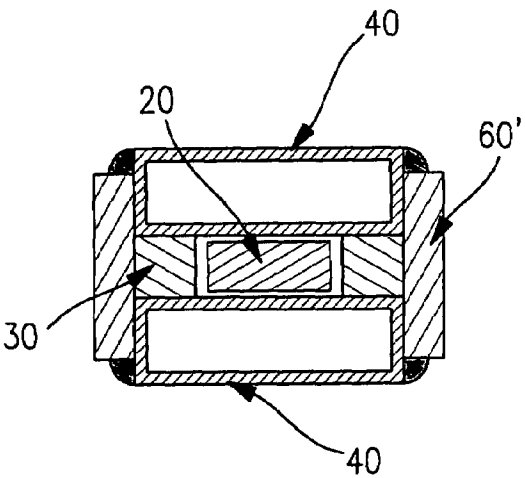
FIG. 6 is a cross sectional end view of a fourth embodiment of a shock-absorbing tie brace in accordance with the present invention.

With reference to FIGS. 5 and 6, a third and fourth embodiments of shock-absorbing tie braces in accordance with the present invention further comprise two additional reinforcing members (60, 60') securely attached between the primary containment members (40). In the third embodiment, the reinforcing members (60) are tubular, whereas the reinforcing members (60') in the fourth embodiment are solid.

Figure 8:
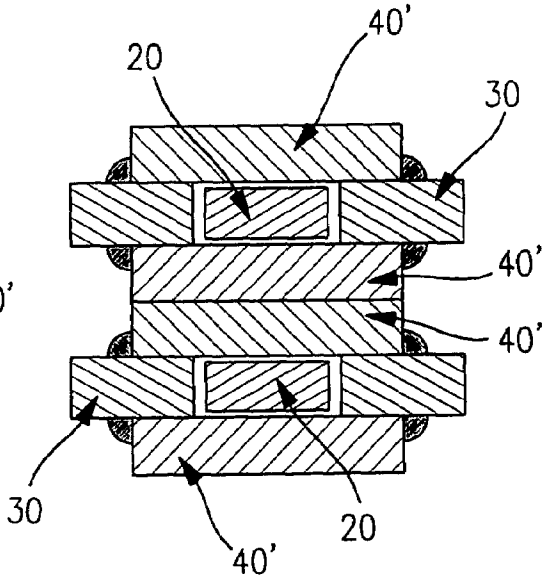
FIG. 8 is a cross sectional end view of a sixth embodiment of a shock-absorbing tie brace in accordance with the present invention.
Figure 7:
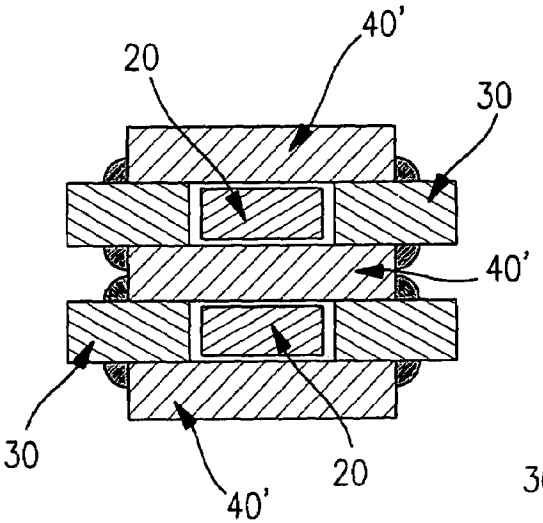
FIG. 7 is a cross sectional end view of a fifth embodiment of a shock-absorbing tie brace in accordance with the present invention.
Figure 9:
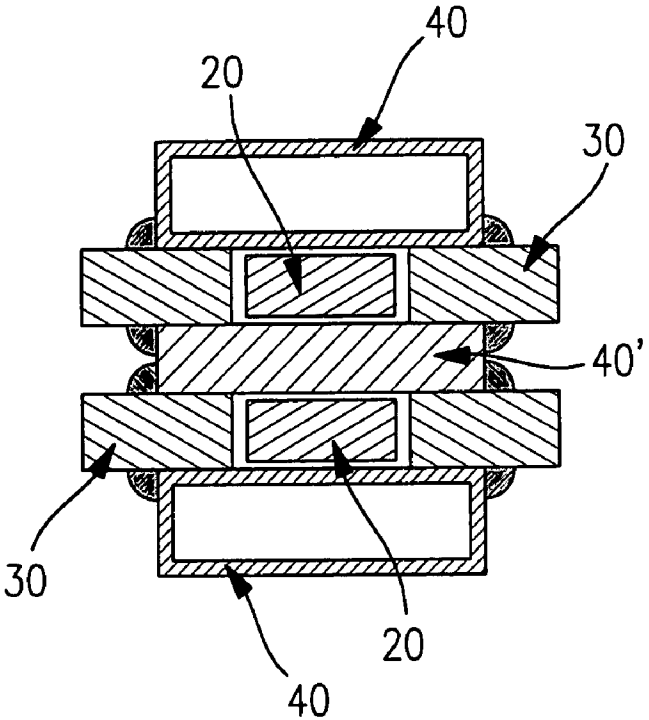
FIG. 9 is a cross sectional end view of a seventh embodiment of a shock-absorbing tie brace in accordance with the present invention.
Figure 11:
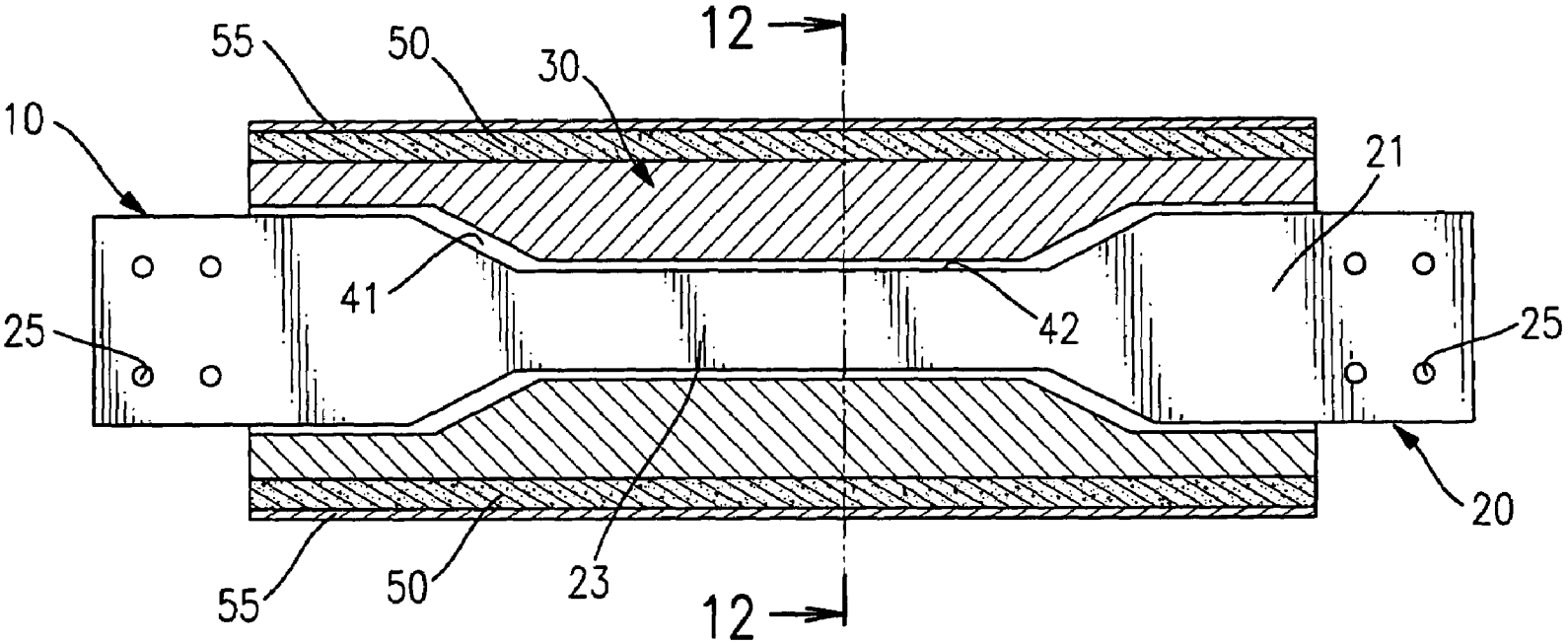
FIG. 11 is a top view in partial cross section of a ninth embodiment of a shock-absorbing tie brace in accordance with the present invention.
Figure 13:
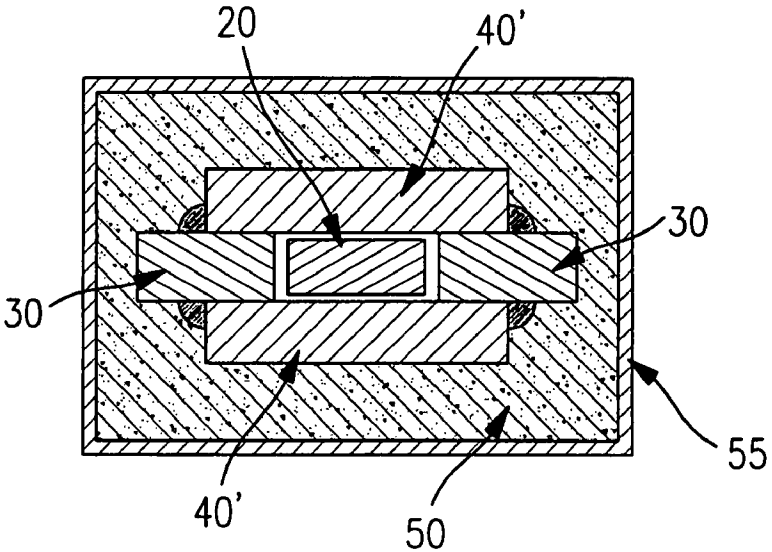
FIG. 13 is a cross sectional end view of a tenth embodiment of a shock-absorbing tie brace in accordance with the present invention.
Figure 12:
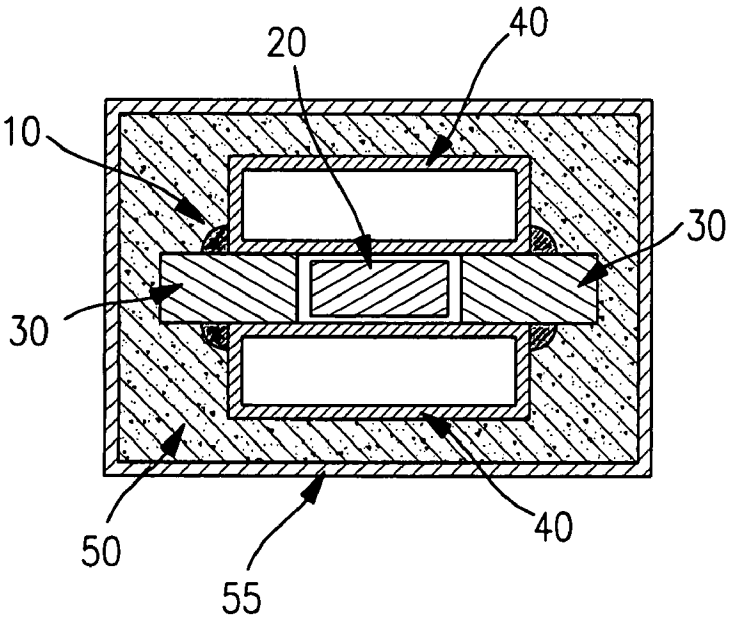
FIG. 12 is a cross sectional end view of the ninth embodiment of the shock-absorbing tie brace in FIG. 11.
Figure 15:
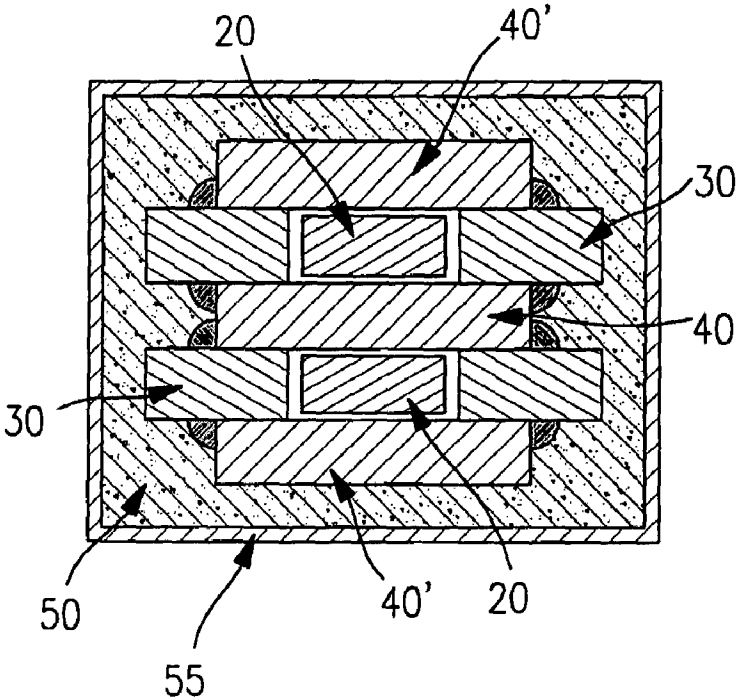
FIG. 15 is a cross sectional end view of a twelfth embodiment of a shock-absorbing tie brace in accordance with the present invention.
Figure 14:
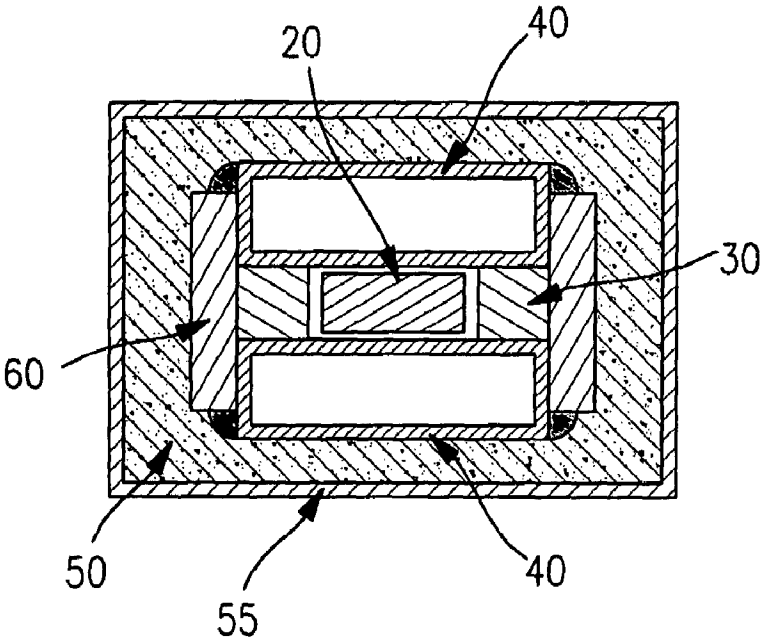
FIG. 14 is a cross sectional end view of an eleventh embodiment of a shock-absorbing tie brace in accordance with the present invention.

With reference to FIGS. 7 to 9, a fifth, sixth and seventh embodiment stack multiple shock-absorbing tie braces to increase the structural strength and shock-absorbing effect. The primary containment members (40, 40') can be either tubular or solid.

Figure 10:
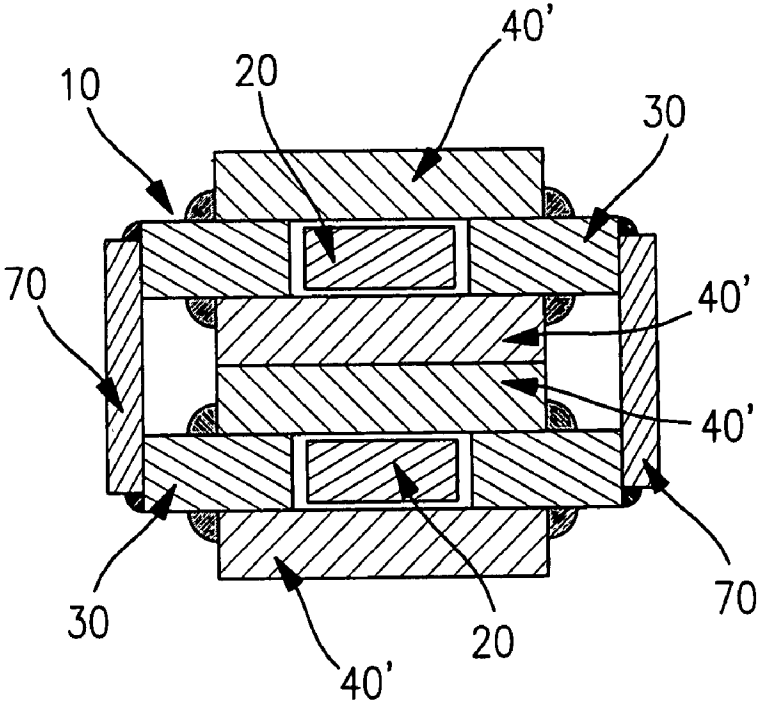
FIG. 10 is a cross sectional end view of a eighth embodiment of a shock-absorbing tie brace in accordance with the present invention.

With reference to FIG. 10, two additional reinforcing connecting members (70) are mounted between the lateral containment members (30) of adjacent shock-absorbing tie braces.

With reference to FIGS. 11 to 15, the shock-absorbing tie brace may further have an outer casing (55) and stuffing material (50). The outer casing (55) is mounted around the central member (10) and the primary containment members (40, 40'). The stuffing material (50) fills the outer casing (55) around the central member (10) and the primary containment members (40, 40'). The stuffing material (50) can be selected from concrete or a resilient material such as rubber or plastic material. The outer casing (55) has a cross section that can be any shape, such as rectangular, circle, oval and so on.

Figure 16:
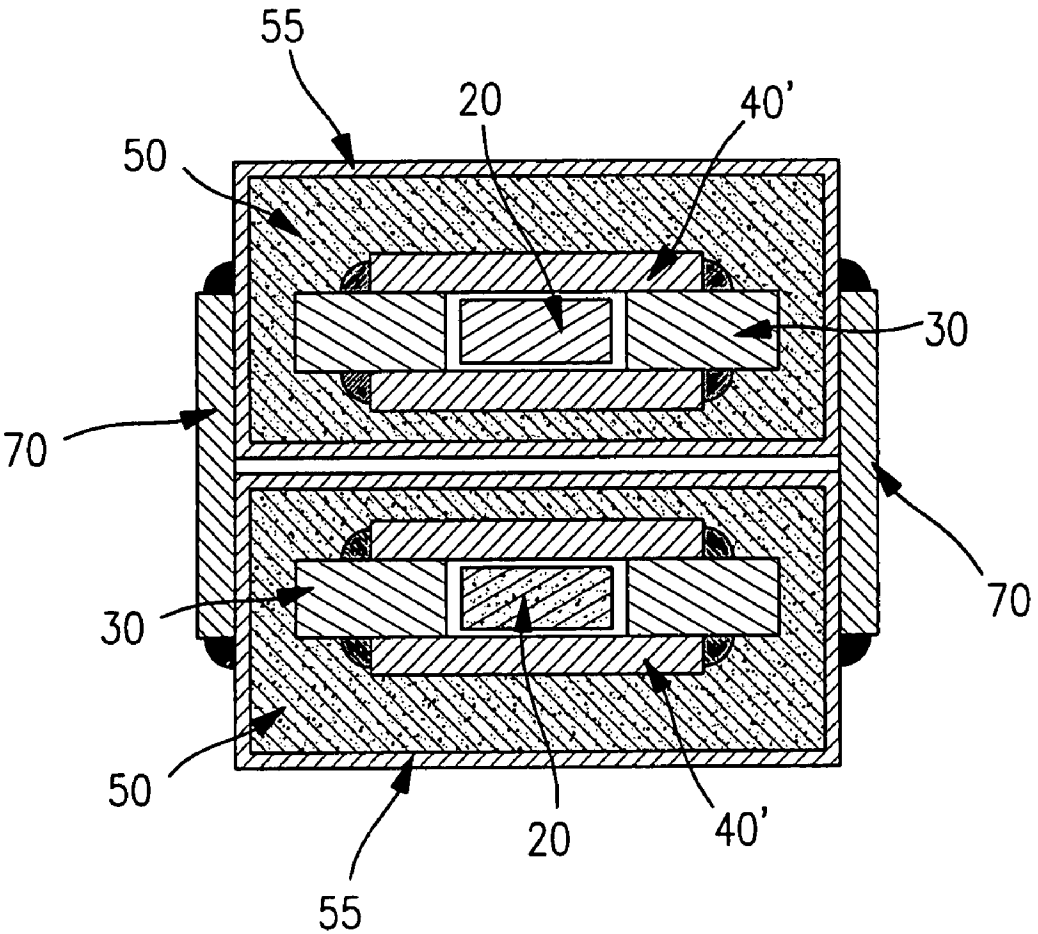
FIG. 16 is a cross sectional end view of a thirteenth embodiment of a shock-absorbing tie brace in accordance with the present invention.

With reference to FIG. 16, two reinforcing connecting members (70) can attach the outer housings (55) of two shock-absorbing tie braces to enhance the structural strength.

Figure 17:
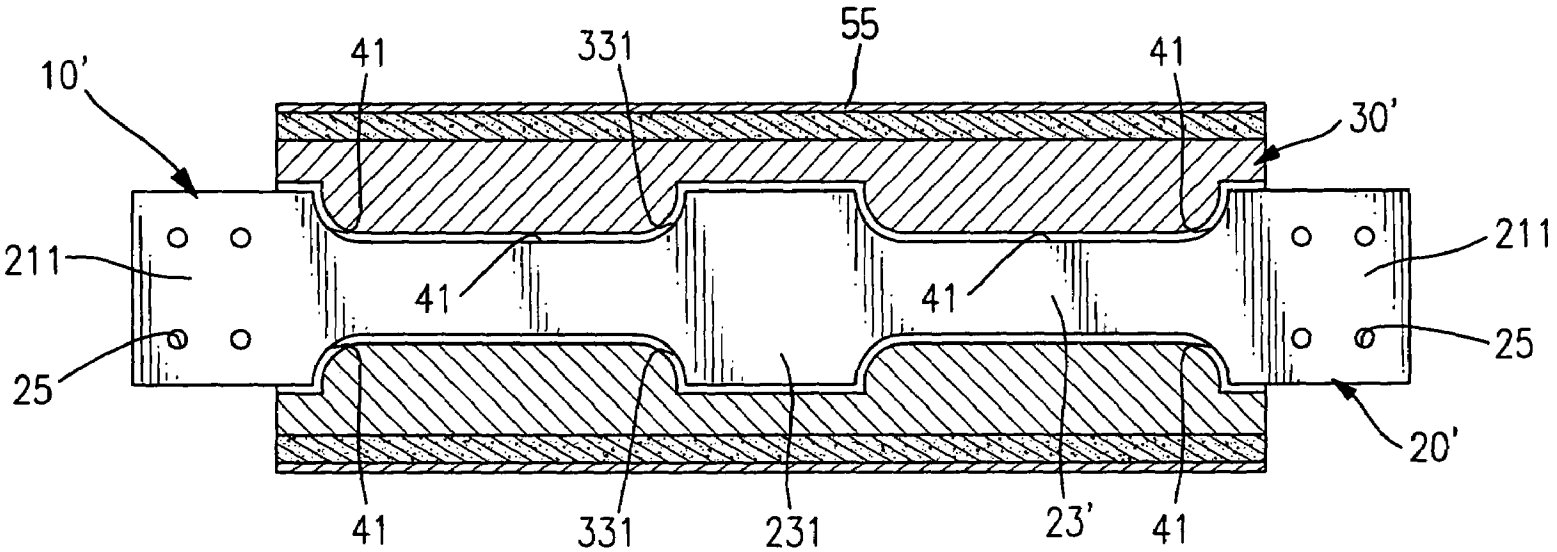
FIG. 17 is a top view in partial cross section of a fourteenth embodiment of a shock-absorbing tie brace in accordance with the present invention.

With reference to FIG. 17, a fourteenth embodiment of a shock-absorbing tie brace in accordance with the present invention comprises a central member (10'), two primary containment members (40,40'), an outer housing (55) and stuffing material (50). The central member (10') comprises a resilient body (20') and two lateral containment members (30'). The resilient body (20') has two enlarged ends (211) and a neck (23') with an enlarged middle segment (231). Each lateral containment member (30') has two narrow ends (not numbered) and a wide middle (not numbered) with a recess (331) corresponding to the enlarged middle segment (231) on the neck (23') of the resilient body (20'). the enlarged middle segment (231) on the neck (23') enhances the structural strength of the resilient body (20').

Figure 18:
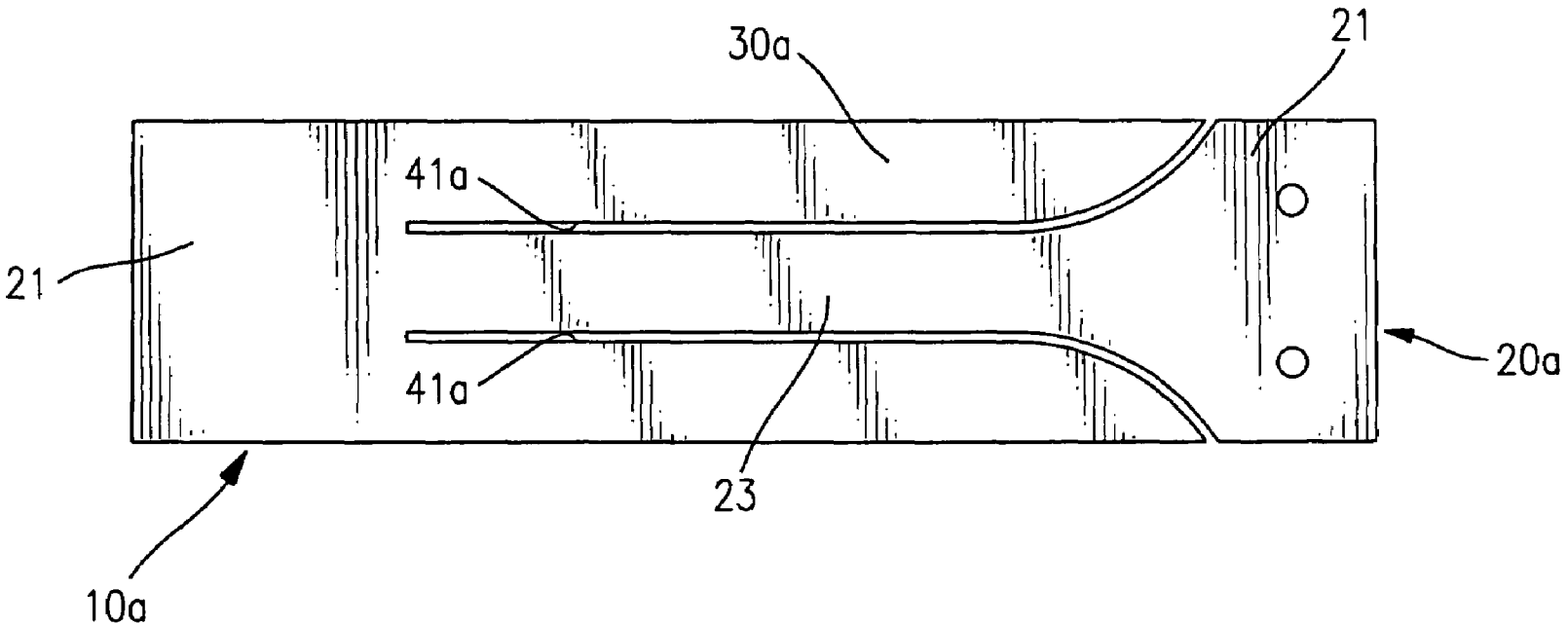
FIG. 18 is a top plan view of a second embodiment of a central member of a shock-absorbing tie brace in accordance with the present invention.
Figure 19:
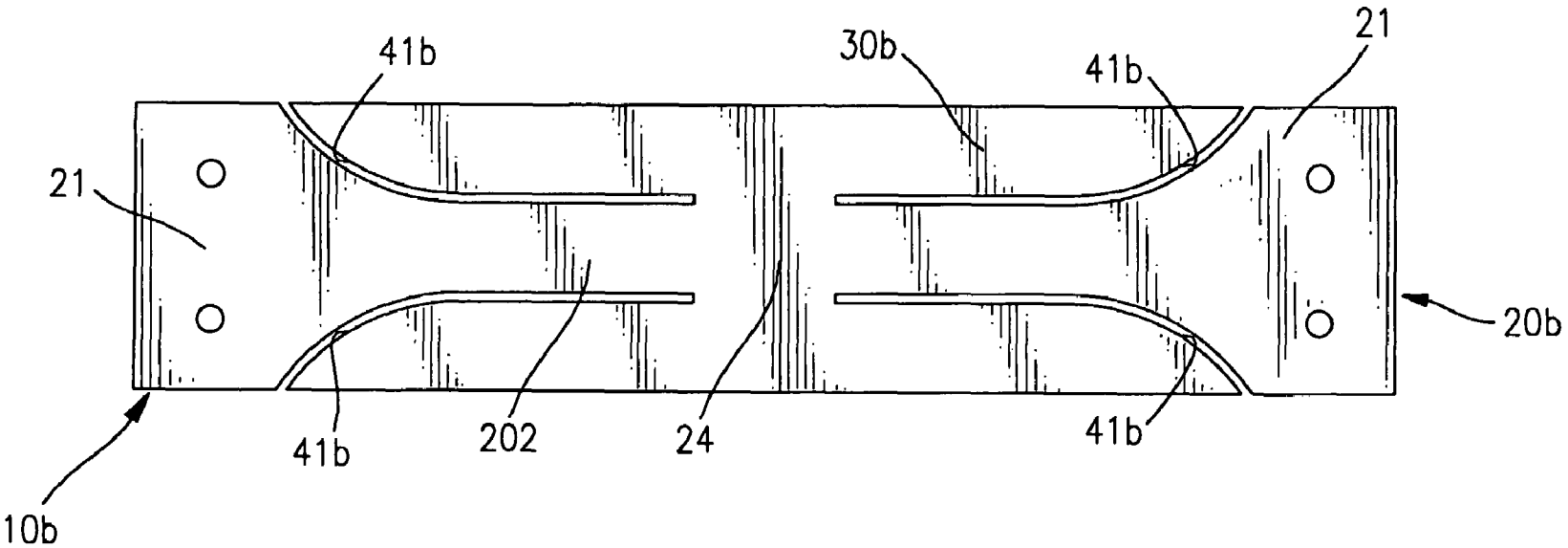
FIG. 19 is a top view of a third embodiment of a central member of a shock-absorbing tie brace in accordance with the present invention.
Figure 20:
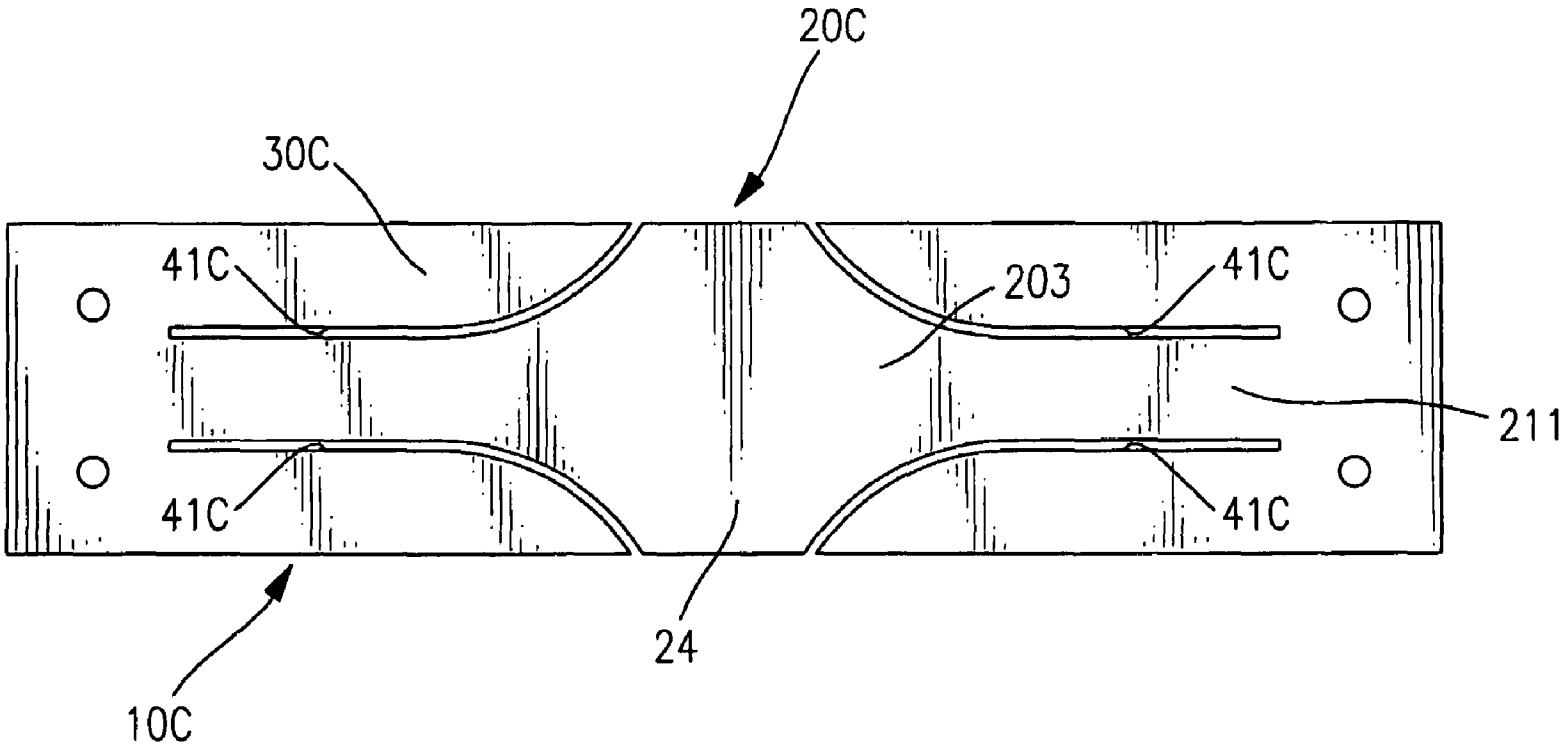
FIG. 20 is a top view of a fourth embodiment of a central member of a shock-absorbing tie brace in accordance with the present invention.

With reference to FIGS. 18 to 20, embodiments of shock-absorbing tie braces in accordance with the present invention may have the resilient body (20*a*, 20*b*, 20*c*) and the lateral containment members (30*a*, 30*b*, 30*c*) of the central member (10*a*, 10*b*, 10*c*) formed as a single piece. Gaps (41*a*, 41*b*, 41*c*) are defined between the resilient body (20*a*, 20*b*, 20*c*) and the lateral containment members (30*a*, 30*b*, 30*c*) to make the resilient body (20*a*, 20*b*, 20*c*) have a resiliency to absorb shock from earthquakes.

With such a shock-absorbing tie brace, the resilient body (20) and the lateral containment members (30) of the central member (10) can be formed by cutting a metal plate. Therefore, manufacturing the shock-absorbing tie brace is easy and saves time and money. In addition, the resilient body (20) is not easily deformed during the manufacturing process, and the structural strength of the shock-absorbing tie brace is enhanced.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A shock-absorbing tie brace for a structure comprising:

at least one central member having a top;

a bottom;

a resilient body with two nonlinear edges; and two lateral containment members respectively having a straight edge and a nonlinear edge corresponding to the nonlinear edge of the resilient body and mounted at opposite edges of the resilient body to define a gap between each lateral containment member and the corresponding edge of the resilient body; and at least two primary containment members being tubular and rectangular in cross section, mounted respectively on the top and bottom of the at least one central member and attached to the lateral containment members of the at least one central member.

2. The shock-absorbing tie brace as claimed in claim 1, wherein the resilient body of each one of the at least one central member comprises two enlarged ends having a width; and a neck formed between the enlarged ends and having a width smaller than the width of the enlarged ends to define two recesses respectively in the sides of the resilient body; and each lateral containment member has two narrow ends; and a wide middle formed between the narrow ends and corresponding to the one of the recesses in the neck of a corresponding resilient body.

3. The shock-absorbing tie brace as claimed in claim 2, wherein each resilient body has multiple through holes defined in the enlarged ends.

4. The shock-absorbing tie brace as claimed in claim 1, wherein each resilient body and the lateral containment members have thickness and the thickness of each resilient body is smaller than the thickness of the lateral containment members.

5. The shock-absorbing tie brace as claimed in claim 2, wherein each resilient body and the lateral containment members have thicknesses and the thickness of each resilient body is smaller than the thickness of the lateral containment members.

6. The shock-absorbing tie brace as claimed in claim 4 further comprising two reinforcing members securely attached between the at least two primary containment members.

7. The shock-absorbing tie brace as claimed in claim 6, wherein the reinforcing members are tubular.

8. The shock-absorbing tie brace as claimed in claim 6, wherein he reinforcing members are solid.

9. The shock-absorbing tie brace as claimed in claim 1 further comprising two reinforcing members securely attached between the at least two primary containment members.

10. The shock-absorbing tie brace as claimed in claim 1 further comprising an outer casing mounted around the at least one central members and the at least two primary containment members to define a space between the outer casing, the at least one central member and the at least two primary containment members; and stuffing material filling the outer casing around the at least one central member and the at least two primary containment members.

11. The shock-absorbing tie brace as claimed in claim 2, wherein each resilient body further has an enlarged middle segment formed on the neck; and each lateral containment member has a cavity defined in the wide middle and corresponding to the enlarged middle segment on the neck of the corresponding resilient body.

12. The shock-absorbing tie brace as claimed in claim 11, wherein the resilient body and the lateral containment members of one of the at least one central body are formed as a single piece.

13. The shock-absorbing tie brace as claimed in claim 2, wherein the resilient body and the lateral containment members of one of the at least one central body are formed as a single piece.

14. The shock-absorbing tie brace as claimed in claim 1, wherein the resilient body and the lateral containment members of one of the at least one central body are formed as a single piece.

15. The shock-absorbing tie brace as claimed in claim 1, wherein he shock-absorbing tie brace comprises two central members and at least three primary containment members mounted respectively on the top and bottom of the central members and attached to the lateral containment members of the central members; and each central member is mounted between two of the at least three primary containment members.

* * * * *